US006646666B2

(12) United States Patent
Matsuoka

(10) Patent No.: US 6,646,666 B2
(45) Date of Patent: Nov. 11, 2003

(54) METHOD OF FORMING A FORGERY-PREVENTIVE IMAGE AND APPARATUS THEREFOR

(75) Inventor: Hiroki Matsuoka, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 75 days.

(21) Appl. No.: 10/034,856

(22) Filed: Dec. 27, 2001

(65) Prior Publication Data

US 2002/0113988 A1 Aug. 22, 2002

(30) Foreign Application Priority Data

Jan. 11, 2001 (JP) ..... 2001-003830

(51) Int. Cl.[7] ..... B41M 3/16; B42D 15/10; B41J 3/26

(52) U.S. Cl. ..... 347/213; 347/1; 347/4; 347/212

(58) Field of Search ..... 347/212, 213, 347/1, 4; 400/120.18

(56) References Cited

U.S. PATENT DOCUMENTS 4,666,320 A * 5/1987 Kobayashi et al. ..... 400/241.1
4,716,145 A * 12/1987 Vanier et al. ..... 503/227
4,923,848 A * 5/1990 Akada et al. ..... 503/227
6,377,291 B2 * 4/2002 Andoh et al. ..... 347/213

FOREIGN PATENT DOCUMENTS

EP 567085 A2 * 10/1993 ..... B41J/2/325

* cited by examiner

*Primary Examiner*—Huan Tran
(74) *Attorney, Agent, or Firm*—Hogan & Hartson, LLP

(57) ABSTRACT

There are provided a method of forming a forgery-preventive image and an apparatus therefor which are capable of easily making a forgery-preventive medium without spoiling ease of determination as to whether forgery has been committed. An image is printed on an ink image-receiving sheet by using a sublimable dye ink, thereby causing the sublimable dye ink to be held by the ink image-receiving sheet. The image-receiving sheet and a medium body overlaid upon each other are heated, thereby causing diffusion of the sublimable dye ink held in the ink image-receiving sheet in a surface of the medium body and color development. The amount of heat applied to the ink image-receiving sheet and the medium body is controlled so as to adjust depth of diffusion of the sublimable dye ink.

27 Claims, 9 Drawing Sheets

METHOD OF FORMING A FORGERY-PREVENTIVE IMAGE AND APPARATUS THEREFOR

BACKGROUND OF THE INVENTION

1. Field of the Invention

This invention relates to a method of forming a forgery-preventive image and an apparatus therefor which are capable of forming a forgery-preventive image on a print medium, such as a card, by using printing technology.

2. Prior Art

In a conventional method of forming a forgery-preventive image, a print medium formed of two (or more) image-receiving layers is used for printing. In the method, after printing on a first layer of the two image-receiving layers, a transparent second layer is affixed onto the first layer, and then printing is performed on the second layer. In this case, images partially different from each other are printed on the respective first and second layers, such that the two images form an entire image in a synthesized manner when they are viewed from the front of the print medium. Further, determination as to whether forgery has been committed is made by cutting the print medium printed with the images and inspecting a cross section of the print medium to determine whether or not the entire image is formed as a multi-layered image.

In the method, however, e.g. when a card is used as a print medium, it is required to carry out complicated and troublesome operations of alignment or positioning of the two images and corresponding edges of the two layers of the card during lamination of image-receiving layers after printing, and hence it takes a lot of time and labor to make the card as a medium printed with a forgery-preventive image, which results in an increase in manufacturing costs.

SUMMARY OF THE INVENTION

It is an object of the invention to provide a method of forming a forgery-preventive image and an apparatus therefor which are capable of easily making a forgery-preventive medium without spoiling ease of determination as to whether forgery has been committed.

To attain the above object, according to a first aspect of the invention, there is provided a method of forming a forgery-preventive image, comprising the steps of:

printing an image on an ink image-receiving sheet by using a sublimable dye ink, thereby causing the sublimable dye ink to be held by the ink image-receiving sheet;

heating the image-receiving sheet and a medium body overlaid upon each other, thereby causing diffusion of the sublimable dye ink held in the ink image-receiving sheet in a surface of the medium body and color development, and controlling an amount of heat applied to the ink image-receiving sheet and the medium body so as to adjust depth of diffusion of the sublimable dye ink.

To attain the above object, according to a second aspect of the invention, there is provided an apparatus for forming a forgery-preventive image, comprising:

printing means for printing an image on an ink image-receiving sheet by using a sublimable dye ink, thereby causing the sublimable dye ink to be held by the ink image-receiving sheet;

heating means for heating the image-receiving sheet and a medium body overlaid upon each other, thereby causing diffusion of the sublimable dye ink held in the ink image-receiving sheet in a surface of the medium body and color development, and heat amount control means for controlling an amount of heat applied to the ink image-receiving sheet and the medium body so as to adjust depth of diffusion of the sublimable dye ink.

According to the method of forming a forgery-preventive image and the apparatus therefor, when an image is printed on the print medium, the sublimable dye ink is impregnated into the ink image-receiving sheet and held therein. Then, the print medium is heated in this state, and this causes diffusion of the sublimable dye ink from the ink image-receiving sheet into the surface layer (surface) of the medium body and color development to form an image.

In general, it is observed that when an image (sublimable dye ink) is transferred from the ink image-receiving sheet to the medium body, the diffusion (transfer) depth of the sublimable dye ink varies with the length of heating time, or more accurately, the amount of heat. That is, the sublimable dye ink penetrates into a deeper location to be fixed thereat as the amount of heat applied thereto increases. Therefore, fixation depth of the sublimable dye ink in the surface layer of the medium body can be kept concealed by finding out the correlation between the amount of heat applied to the print medium and diffusion depth of the sublimable dye ink in the medium body and controlling the amount of heat applied to the print medium. Further, by inspecting a cross section of the medium body, it is possible to easily determine whether or not the medium body is a forgery.

Preferably, the method further includes the step of dividing data of the image into data of a plurality of divisional images, and the step of separating the ink image-receiving sheet and the medium body which have been heated, from each other, and the step of printing includes printing one of the plurality of divisional images on a new ink image-receiving sheet, and wherein a cycle of the step of printing, the step of heating, and the step of separating is repeated a number of times corresponding to the number of the plurality of divisional images, and wherein the step of controlling the amount of heat includes progressively reducing the amount of heat as the cycle is repeated.

Preferably, the apparatus further includes image dividing means for dividing data of the image into data of a plurality of divisional images, and separation means for separating the ink image-receiving sheet and the medium body which have been heated, from each other, and control means for controlling operations of the printing means, the heating means, the separation means, and the heat amount control means, based on the data of the plurality of divisional images formed by the image dividing means, and wherein printing means prints one of the plurality of divisional images on a new ink image-receiving sheet, and the control means carries out control such that a cycle of printing on the ink image-receiving sheet by the printing means, heating of the ink image-receiving sheet and the medium body overlaid upon each other by the heating means, and separation of the ink image-receiving sheet and the medium body overlaid upon each other from each other by the separation means is repeated a number of times corresponding to the number of the plurality of divisional images and that the amount of heat is progressively reduced by the heat amount control means as the cycle is repeated.

According to these preferred embodiments, an image is divided into a plurality of divisional images, and printing and heating are repeatedly carried out on a divisional image-by-divisional image basis to form a desired entire image. Further, in the processes of the repeated heating operations, the amount of heat applied to the print medium is progressively reduced. Accordingly, a divisional images formed earlier is fixed at a deeper location in the surface layer of the medium body, whereas a divisional image formed later is fixed at a shallower location. Therefore, fixation depth of sublimable dye ink of each divisional image in the surface layer of the medium body can be kept concealed. Further, by determining the fixation depth of each sublimable dye ink of each divisional image through inspection of a cross section of the medium body, it is possible to easily determine whether or not the medium body is a forgery.

More preferably, the method further includes the step of overlaying the ink image-receiving sheet on the medium body, prior to the step of printing, and the cycle includes the step of overlaying.

More preferably, the apparatus further includes ink image-receiving sheet supply means for supplying a new ink image-receiving sheet, and overlay means for overlaying the ink image-receiving sheet and the print medium upon one another, and the cycle includes supplying of the ink image-receiving sheet by the ink image-receiving sheet supply means, and overlaying of the ink image-receiving sheet and the print medium upon one another by the overlay means.

Further preferably, the overlay means overlays the ink image-receiving sheet and the medium body upon each other prior to printing by the printing means.

More preferably, the ink image-receiving sheet is formed such that the ink image-receiving sheet can be affixed to the medium body, and the step of overlaying includes affixing the ink image-receiving sheet to the medium body.

According to this preferred embodiment, it is not only easy to deal with the print medium, but also possible to transfer the sublimable dye ink stably from the ink image-receiving sheet to the medium body. Particularly, it is possible to use heating means of non-contact type.

Preferably, the method includes the step of overlaying the ink image-receiving sheet on the medium body, which is carried out posterior to the step of printing and simultaneously with the step of heating, and wherein the cycle includes the step of overlaying which is carried out simultaneously with the step of heating.

Similarly, the overlay means is formed integrally with the heating means, and overlays the ink image-receiving sheet and the medium body upon each other posterior to printing of the divisional ink by the printing means and simultaneously with heating by the heating means.

More preferably, the step of dividing the data of the image includes dividing the data of the image into data of a plurality of divisional images having respective different colors.

More preferable, the image dividing means divides the data of the image into data of a plurality of divisional images having respective different colors.

According to these preferred embodiments, data of the image is divided into data of a plurality of divisional images having respective different colors (color division; more accurately, color decomposition) and then printing and heating are repeatedly carried out on a divisional image-by-divisional image basis to form a desired entire image. In the repeated heating operation, the amount of heat applied to the print medium is progressively reduced. Accordingly, a divisional image formed earlier is fixed at a deeper location in the surface layer of the medium body, whereas a divisional image formed later is fixed at a shallower location. Therefore, fixation depth of sublimable dye ink of each color in the surface layer of the medium body can be kept concealed. Further, by determining the fixation depth and color of each sublimable dye ink through inspection of a cross section of the medium body, it is possible to easily determine whether or not the medium body is a forgery.

Further preferably, the number of the plurality of divisional images is two, and the method further includes the step of setting one of the two divisional images to be formed when the cycle is executed first to one having a darker color, and another of the two divisional images to be formed when the cycle is executed next to one having a lighter color.

According to this preferred embodiment, the divisional image having a darker color is fixed at a deeper location in the surface layer of the medium body, while the divisional image having a brighter color is fixed at a shallower location in the same. Therefore, by checking the brightness and darkness of the colors of a cross section of the medium body, it is also possible to easily determine whether or not the medium body is a forgery.

More preferably, the step of dividing the data of the image includes dividing the data of the image into data of a plurality of divisional images representative of respective different image elements.

More preferably, the image dividing means divides the data of the image into data of a plurality of divisional images representative of respective different image elements.

According to these preferred embodiments, the data of the image is divided into data of a plurality of divisional images representing of respective image elements, and then printing and heating are carried out on a divisional image-by-divisional image basis to form a desired entire image. In the repeated heating operations, the amount of heat applied to the print medium is progressively reduced. Accordingly, a divisional image formed earlier is fixed at a deeper location in the surface layer of the medium body, whereas a divisional image formed later is fixed at a shallower location. Therefore, fixation depth of sublimable dye ink of each divisional image in the surface layer of the medium body can be kept concealed. Further, by checking the fixation depth and presence or absence of each divisional image through inspection of a specific cross section of the medium body, it is possible to easily determine whether or not the medium body is a forgery.

Further preferably, the number of the plurality of divisional images is two, and one of the two divisional images to be formed when the cycle is executed first, and another of the two divisional images to be formed when the cycle is executed next are caused to partially overlap each other.

According to this preferred embodiment, the divisional pattern of the image is complicated, and hence it is possible to make forgery very difficult, without spoiling ease of determination as to whether forgery has been committed.

More preferably, the step of dividing the data of the image includes dividing the data of the image into data of a plurality of divisional images having respective different densities.

More preferably, the image dividing means divides the data of the image into data of a plurality of divisional images having respective different densities.

According to these preferred embodiments, the data of an image is divided into data of a plurality of divisional images having respective different densities, and then printing and heating are repeatedly carried out on a divisional image-by-divisional image basis to form a desired entire image. In the repeated heating operations, the amount of heat applied to the print medium is progressively reduced. Accordingly, a divisional image formed earlier is fixed at a deeper location in the surface layer of the medium body, whereas a divisional image formed later is fixed at a shallower location. Therefore, fixation depth of sublimable dye ink of each density in the surface layer of the medium body can be kept concealed. Further, by checking the fixation depth and density of each sublimable dye ink through inspection of a cross section of the medium body, it is possible to easily determine whether or not the medium body is a forgery.

Preferably, the number of the plurality of divisional images is two, and the method further includes the step of setting one of the two divisional images to be formed when the cycle is executed first to one having a higher density, and another of the two divisional images to be formed when the cycle is executed next to one having a lower density.

According to this preferred embodiment, a divisional image having the higher density is fixed at a deeper location in the surface layer of the medium body, while a density-divisional image having the lower density is fixed at a shallower location in the same. The difference in density between the two divisional images having respective different densities is particularly conspicuous, so that by inspecting a cross section of the medium body, it is even easier to determine as to whether or not the medium body is a forgery.

More preferably, the medium body includes a white layer forming a substrate layer and permitting ink fixation, and a transparent layer laminated on a surface of the white layer and permitting ink fixation, and the number of the plurality of divisional images is two, the sublimable dye ink being heated and fixed in a surface layer of the white layer when the cycle is executed first, while the sublimable dye ink being heated and fixed in the transparent layer when the cycle is executed next.

According to this preferred embodiment, simply by checking whether each of the divisional images is fixed in the white layer or in the transparent layer, it is possible to determine very easily whether or not the medium body is a forgery, Further, preferably, the medium body has a fluorine film layer laminated on an outermost surface layer thereof on which the ink image-receiving sheet is to be overlaid.

According to this preferred embodiment, when the ink image-receiving sheet is heated, the sublimable dye ink held in the ink image-receiving sheet passes through the fluorine film layer, followed by being diffused and fixed in the surface layer of the medium body. As a result, after the ink image-receiving sheet is removed, the fluorine film layer functions as a protective layer (laminating layer) for protecting the image fixed in the surface layer of the medium body. The fluorine film layer is not only weather-resistant, light-resistant, heat-resistant, rub or abrasion-resistant and chemical-resistant, but also glossy, so that it is possible to make an excellent media body.

Preferably, the medium body is a card.

According to this preferred embodiment, a card having forgery preventive function can be produced easily at low costs.

Preferably, the step of printing includes printing by an ink jet printing method.

Preferably, the printing means carries out printing by an ink jet printing method.

According to these preferred embodiments, it is possible to carry out printing easily without any contact with the ink image-receiving sheet and form a clear image. Further, a color image, in particular, can be formed easily and speedily.

Preferably, the step of heating includes causing the print medium to pass by a heat source which is being driven for heating, at a constant speed, and the step of controlling the amount of heat includes controlling at least one of a temperature of the heat source and a speed of the print medium.

Preferably, the heating means includes a heat source, and a media feed mechanism for causing the print medium to pass by the heat source which is being driven for heating, at a constant speed, and the heat amount control means controls the amount of heat by controlling at least one of a temperature of the heat source and a speed of the print medium fed by the media feed mechanism.

According to these preferred embodiments, the control of the amount of heat applied to the print medium is carried out by controlling at least one of the temperature of the heat source and the speed of the print medium. Therefore, it is possible to carry out the control of the heat amount by selectively using the two control elements, which facilitates the control and makes it possible to heat the whole print medium uniformly.

The above and other objects, features, and advantages of the invention will become more apparent from the following detailed description taken in conjunction with the accompanying drawings.

DETAILED DESCRIPTION OF PREFERRED EMBODIMENTS

The invention will now be described in detail with reference to drawings showing embodiments thereof. An image-forming apparatus to which are applied the method of forming a forgery-preventive image and the apparatus therefor according to a first embodiment of the present invention performs printing of images, such as letters, figures, a background, and so forth, on a card (medium body), such as a cash card or a credit card having a predetermined thickness, by the ink jet printing method, using a sublimable dye ink, and then applies heat treatment to the printed card while feeding the same, to thereby form a forgery-preventive image thereon.

Figure 1:
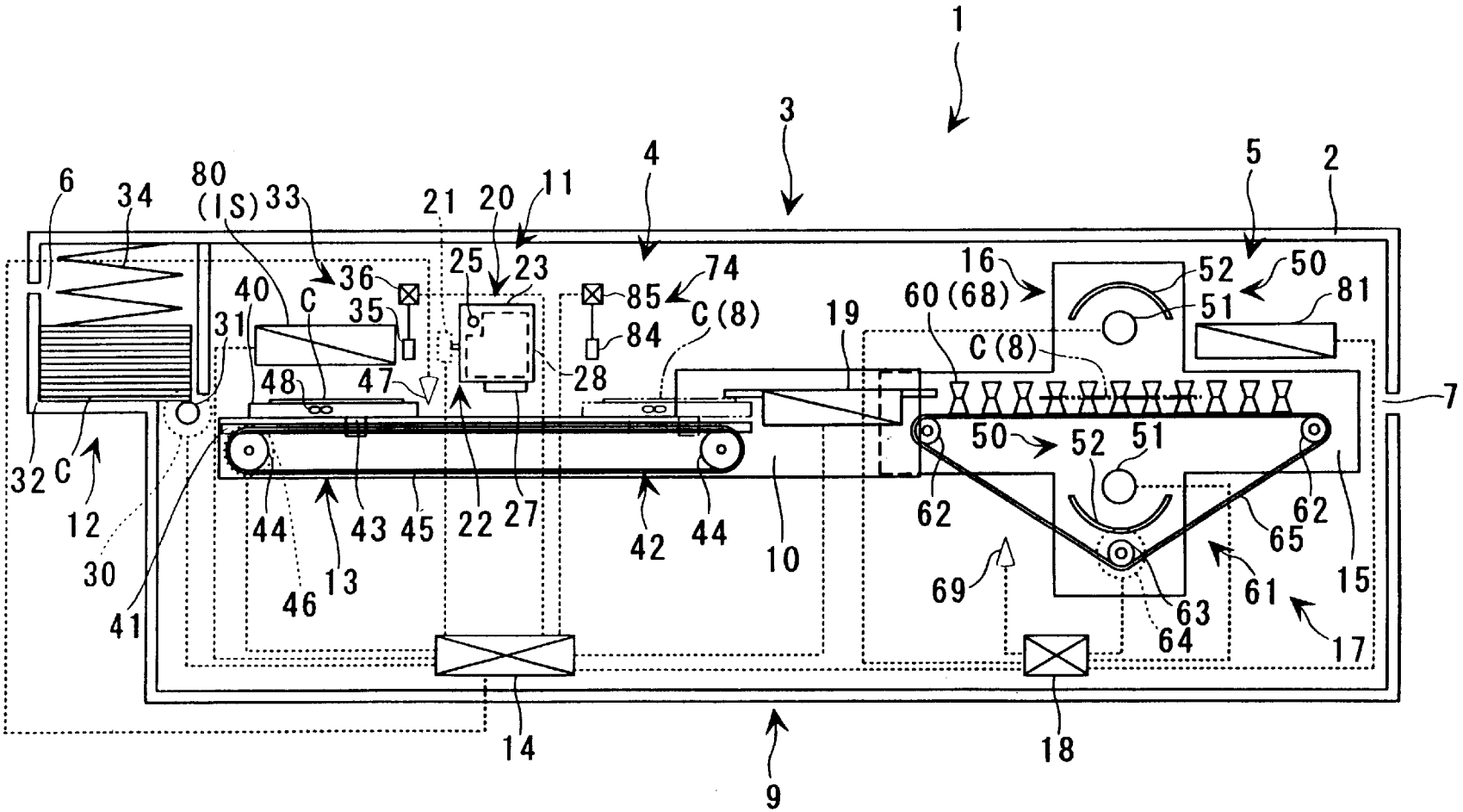
FIG. 1 is a cross-sectional view schematically showing the internal construction of an image-forming apparatus for cards, according to a first embodiment of the present invention.

Referring first to FIG. 1, there is schematically shown the internal construction of the image-forming apparatus. As shown in the figure, the image-forming apparatus 1 has an apparatus body 3 including an outer shell formed by a box-shaped casing 2, a printer block 4 arranged at a location leftward of the central portion of the apparatus body 3, for printing on a card C, and a heater block 5 arranged at a location rightward of the same for applying heat treatment to a printed card C. Further, the apparatus body 3 includes a controller 9 for controlling the printer block 4 and the heater block 5. In a printer block-side upper corner portion of the casing 2, there is formed a card supply port 6 via which cards C are introduced into the apparatus, while in an intermediate portion of a heater block-side side wall of the casing 2, there is formed a card exit 7 via which a card C is delivered out of the apparatus. Further, in the apparatus body 3, a transport passage 8 for transporting a card C extends horizontally and linearly in a manner communicating between the card supply port 6 and the card exit 7.

The printer block 4 is supported by left and right printer-block frames 10. The printer block 4 is comprised of a printer device 11 which carries out printing on the card C by a reciprocating head unit 20, a card feeder 12 which feeds cards C introduced via the card supply port 6, one by one, to the printer device 11, a printer-block conveyor device 13 which sucks a card C fed from the card feeder 12 and conveys the card C along the transport passage 8 to the printer device 11, a sheet-laminating device 80 which is brought to the card C on the printer-block conveyor device 13 to laminate an ink image-receiving sheet IS onto the card C, and a printer-side controller 14 which performs centralized control of these devices 11, 12, 13, 80.

Each of the cards C sent one by one from the card feeder 12 is received by the printer-block conveyor device 13, and then, an ink image-receiving sheet IS is laminated onto the card C. Thereafter, the card C is subjected to printing while passing by the head unit 20, followed by being sent to the heater block 5. While the card C is fed or advanced intermittently when passing under the head unit 20, the head unit carries out printing on the card C by reciprocating in a direction orthogonal to the card-feeding direction. More specifically, printing is performed by the ink jet method using the sublimable dye ink such that the feed of the card C and the reciprocating motion of the head unit 20 correspond to the main scanning and the sub scanning in printing technology, respectively.

The heater block 5 is supported by left and right heat-block frames 15. The heater block 5 is comprised of a heater device 16 which subjects the printed card C received from the printer block 4 to heat treatment, a heater-block conveyor device 17 which conveys the card C received from the printer-block conveyor device 13 along the transport passage 8 to pass the card C through the heater device 16 and then delivers the same out of the casing 2 via the card exit 7, a sheet peeler device 81 which peels (separates) the ink image-receiving sheet IS from the heated card C, and a heater-side controller 18 which performs centralized control of the devices 16, 17, 81. Each card C fed from the printer block 4 eventually has a printed image fixed thereon, followed by being delivered out via the card exit 7.

Between the printer block 4 and the heater block 5, there is arranged a card transfer device 19 on the transport passage 8, for properly transferring the card C from the printer-block conveyor device 13 to the heater-block conveyor device 17. The card transfer device 19, which is supported by the printer-block frames 10 or the heater-block frames 15, once receives a card C from the printer-block conveyor device 13 and then transfers the same to the heater-block conveyor device 17.

The printer-side controller 14 and the heater-side controller 18 are formed by a unitary controller 9 including a CPU 210 for controlling various operations of the image-forming apparatus 1 (which will be described in detail hereinafter). As described above, the controller 9 controls the printer block 4 and the heater block 5 such that they are operated separately and in a manner correlated with each other, to carry out printing of an image on each card C fed to the printer block 4, and then apply heat treatment to the printed card C for fixing the image, followed by delivering the same out of the casing 2 via the card exit 7. Now, the card C will be described in detail prior to description of each component device of the image-forming apparatus 1.

Figure 2A:
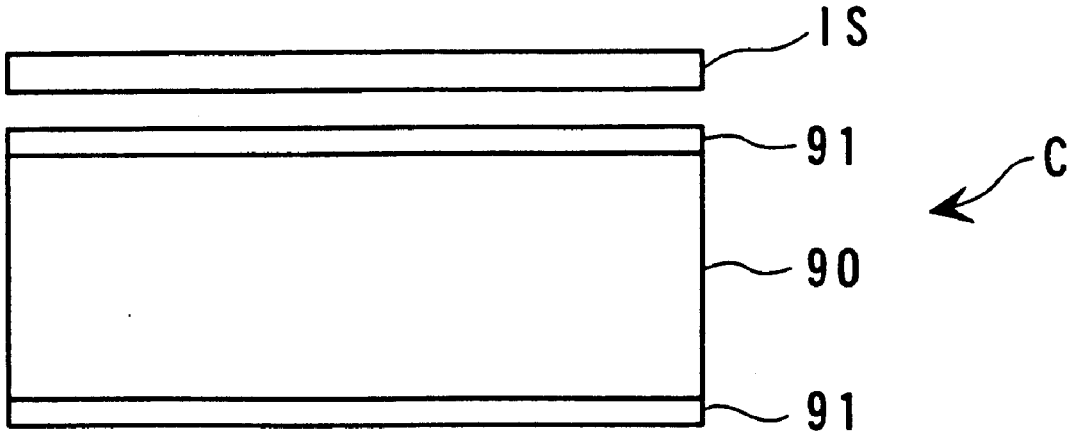
FIGS. 2A and 2B are cross-sectional views of two kinds of cards, schematically showing respective laminate structures and ink image-receiving sheets thereof.
Figure 2B:
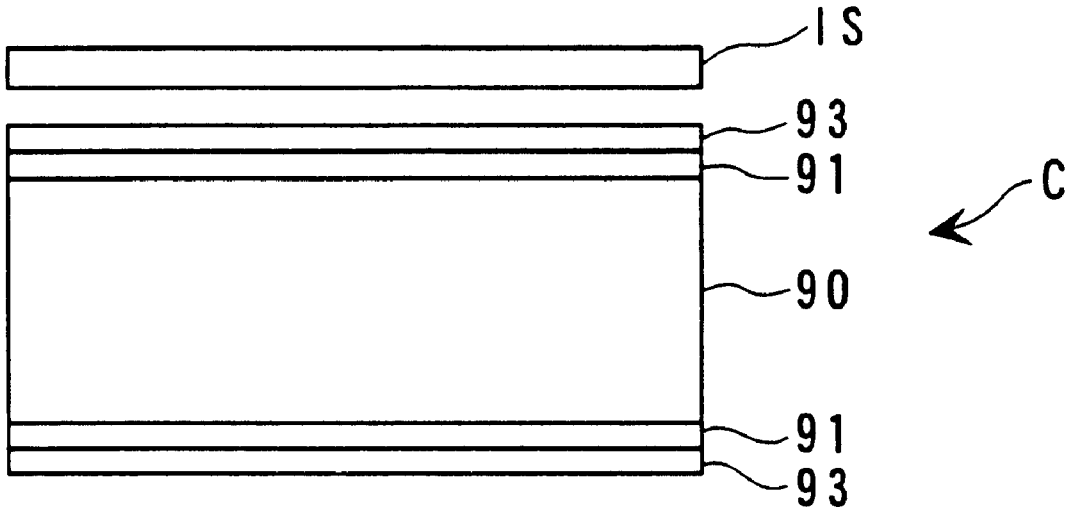

FIGS. 2A and 2B show laminate structures of two kinds of cards C. In the present embodiment, there are provided an inexpensive card shown in FIG. 2A and a high-grade card shown in FIG. 2B. Each of the two cards C is comprised of a substrate layer 90, and ink-fixing layers 91 laminated on respective opposite surfaces of the substrate layer 90, and has a laminate structure symmetrical with respect to the substrate layer 90. In short, the cards C are each formed such that double-sided printing can be effected thereon. Further, in the card C of FIG. 2B, each of the ink-fixing layers 91 has a fluorine film layer 93 laminated on the surface thereof, as a substitute for a laminating film. In the card C of FIG. 2A, the ink-receiving sheet IS coated with an adhesive is affixed to the surface of one of the ink-fixing layers 91 as required, while in the card C of FIG. 2B, it is affixed to the surface of one of the fluorine film layers 93 as required.

The substrate layer 90 of the card C is formed of a plastic film formed e.g. of PVC (polyvinyl chloride) or PET (polyethylene terephthalate), or a synthetic paper so as to maintain the rigidity of the entire card C. Further, in general, the substrate layer 90 is basically formed of a white material. The ink-fixing layer 91 is formed e.g. of a transparent PET film and functions as a layer which is impregnated with a sublimable dye ink to be fixed at the final stage of a printing process. On the other hand, while the ink image-receiving sheet IS is capable of temporarily holding the sublimable dye ink directly ejected thereon for printing, it is formed of a hydrophilic resin material which is easy to peel off by heating. More specifically, stickiness of the adhesive on the ink image-receiving sheet IS is reduced by heating, which makes the sheet IS easy to peel off.

Figure 3A:
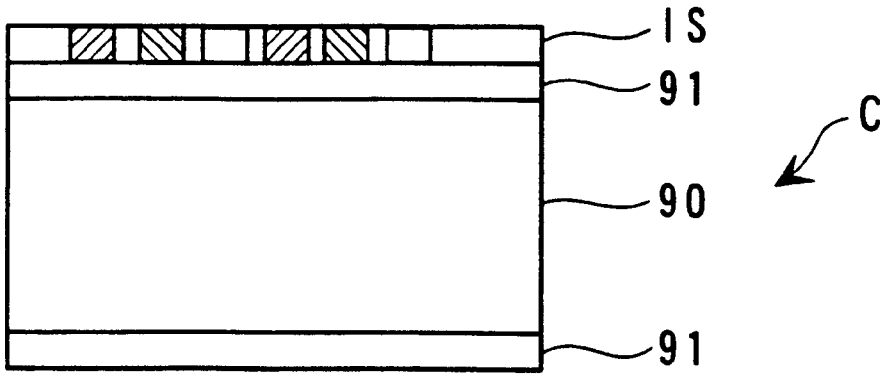
FIGS. 3A to 3C are cross-sectional views of a card, schematically illustrating a process of an image being formed on the card in the first embodiment.
Figure 3B:
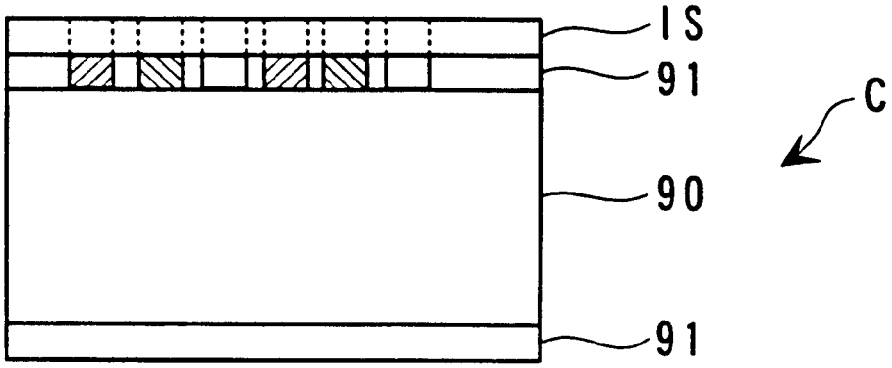
Figure 3C:
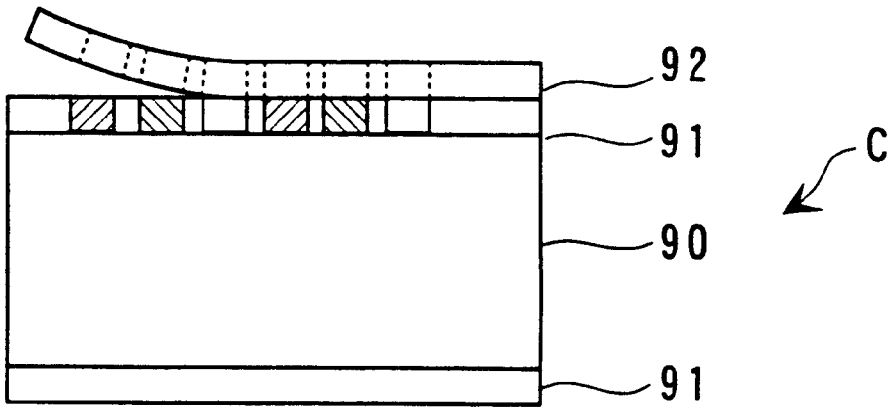

As shown in FIGS. 3A to 3C, when an image is printed by the ink jet printing method with an ink image-receiving sheet IS affixed to the card C, ink droplets of the sublimable dye ink are impregnated into the ink image-receiving sheet IS and held therein. The ink droplets penetrate close to the boundary between the ink image-receiving sheet IS and the ink-fixing layer 91 thereunder. When the card C is heated in this state, the ink droplets further penetrate deep into the ink-fixing layer 91 as migration particles having sizes at a molecular level. In other words, the heating causes the evaporation/diffusion of the ink droplets held in the ink image-receiving sheet IS and color development in the ink-fixing layer 91, whereby the image is formed and fixed in the ink-fixing layer 91. Thereafter, the ink image-receiving sheet IS is removed to expose the ink-fixing layer 91, whereby the card C having the image fixed in the ink-fixing layer 91 is produced.

Similarly, when the FIG. 2B card C having the fluorine film layer 93 laminated thereon is used for printing, ink droplets are impregnated into the ink image-receiving sheet IS and held therein. When the card C is heated in this state, the ink droplets pass through the fluorine film layer 93 so as to be diffused and fixed in the ink-fixing layer 91. Then, when the ink image-receiving sheet IS is removed, the card C is produced which has the fluorine film layer 93 as an outermost surface layer thereof for protection of the image fixed in the ink-fixing layer 91. Thus, the card C having the image formed thereon becomes more excellent in weather resistance, light resistance, heat resistance, rub or abrasion resistance and chemical resistance due to characteristics of the fluorine film layer 93. Further, the fluorine film layer 93 gives a high gloss to the card C.

In this connection, it is observed that fixation depth of the sublimable dye ink diffused/fixed in the surface layer (ink-fixing layer 91) of a card C varies according to the length of heating time (or the amount of heat). More specifically, the fixation depth of the sublimable dye ink is increased with an increase in the amount of heat applied thereto, and reduced with a decrease in the same. According to the above observation, when a particularly large amount of heat is applied, the sublimable dye ink readily passes through the ink-fixing layer 91 and reaches the substrate layer 90.

It should be noted that the ink image-receiving sheet IS is preferably formed of a material having a dark color. This makes it possible to heat the whole surface of a card C uniformly in a heating process by a light source, thereby forming a high-quality print image without unevenness of printing. Further, it is preferred that the ink image-receiving sheet IS is slightly larger than the card C for easy separation from the card C. This makes it possible to provide a peeling margin for the ink image-receiving sheet IS as well as to carry out proper printing even up to edges of the card C (whole surface or edge-to-edge printing). Moreover, since it is possible to fix ink even in the substrate layer 90, the transparent ink-fixing layer 91 can be dispensed with for reduction of manufacturing costs.

Next, the components of the printer block 4 will be described in detail with reference to FIG. 1. The printer device 11 is comprised of the head unit 20, a carriage motor 21 as a drive source, and a reciprocating mechanism 22 which receives torque from the carriage motor 21 to reciprocate the head unit 20. The carriage motor 21 is connected to the printer-side controller 14. The head unit 20 is comprised of an ink jet head 27 having a plurality of nozzles formed in an underside surface thereof, an ink cartridge 28 which supplies ink to the ink jet head 27, and a carriage 23 carrying the ink jet head 27 and the ink cartridge 28. The ink cartridge 28 contains sublimable dye inks of four colors, i.e. yellow (Y), cyan (C), magenta (M), and black (K). The ink cartridge 28 may contain inks of six colors including two other colors, i.e. light cyan and light magenta, in addition to the above four.

The sublimable dye inks are each formed of a sublimable dye which undergoes sublimation by heat. As described above, each sublimable dye ink is impregnated into the ink image-receiving sheet IS and once held therein. Then, the sublimable dye ink is transferred into the ink-fixing layer 91 under the ink image-receiving sheet IS by heat applied in the heating process, and undergoes diffusion/evaporation and color development.

The reciprocating mechanism 22 includes a carriage guide shaft 25 having opposite ends thereof supported by left and right guide frames and a timing belt, not shown, extending in parallel with the carriage guide shaft 25. The carriage 23 is supported by the carriage guide shaft 25 such that the carriage 23 can perform reciprocating motion. Further, the carriage 23 has a portion thereof fixed to the timing belt. When the carriage motor 21 drives the timing belt via a pulley to cause the same to travel in the normal and reverse directions, the carriage 23 performs reciprocating motion while being guided by the carriage guide shaft 25. During this reciprocating motion of the carriage 23, ink is properly ejected from the ink jet head 27, whereby printing is effected on the card C.

The card feeder 12 is comprised of a feed motor 30 as a drive source, a feed roller 31 rotated by the feed motor 30, a card cassette 32 containing a plurality of cards c in a stacked manner, and a first setting mechanism 33 for properly setting a card C on the printer-block conveyor device 13. The card cassette 32 is formed by projecting a rear side portion of the casing 2 outward, such that it has an inner plane shape generally similar to the plane shape of the card C. Further, the card cassette 32 has a predetermined depth which allows a plurality of cards C to be set in a stacked manner. The card supply port 6 is formed in an upper portion of the card cassette 32, and when cards C are stacked up to the card supply port 6, the upper surface of the topmost card C is pressed downward by a spring 34.

The feed roller 31 is arranged under a front portion of the card cassette 32 in a manner held in rolling contact with a forward portion of the underside surface of a lowermost one of the stacked cards C. The feed motor 30 is connected to the printer-side controller 14, for control of rotation of the feed roller 31. A front wall of the card cassette 32 extends downward to a location below which a lowermost card C alone is allowed to pass. The front wall blocks forward motion of cards C above the lowermost card C during feeding of the lowermost card C by the feed roller 31, whereby the cards C can be reliably sent forward one by one.

The first setting mechanism 33 is arranged at a location immediately above a suction table 40, referred to hereinafter, which has moved to a proximal end side of the transport passage 8, and comprised of a first positioning plate 35 which can move vertically, and a first solenoid 36 as a drive source for causing the vertical motion of the first positioning plate 35. The first solenoid 36 is connected to the printer-side controller 14 and starts operating in synchronism with the feed roller 31. More specifically, when the feed motor 30 stars to be driven, the first solenoid 36 also starts to be energized, whereby the first positioning plate 35 starts to move downward simultaneously with the start of rotation of the feed roller 31.

The extreme forward end of the card C having been flicked from the feed roller 31 is brought into abutment with the first positioning plate 35 moved to its lowermost position by the first solenoid 36, whereby the card C is positioned and set on the suction table 40. In this case, the suction table 40 has already started sucking operation, so that the card C brought into abutment with the first positioning plate 35 is instantly attracted onto the surface of the suction table 40.

The sheet-laminating device 80 is comprised of a laminating mechanism, not shown, for holding an ink image-receiving sheet IS and laminating the same on a card C on the suction table 40 and a lift mechanism, not shown, for lifting and lowering the laminating mechanism. The laminating mechanism and the lift mechanism are connected to the printer-side controller 14.

The printer-block conveyor device 13 is comprised of the square suction table 40 for sucking and holding the card C, a pair of left and right guide rails 41, 41 extending along the transport passage 8, and a printer-block conveyor belt mechanism 42 for moving the suction table 40 along the guide rails 41, 41. The suction table 40 has the upper surface thereof formed with numerous suction holes, not specifically shown, and at the same time incorporates a suction fan 48 communicating with the suction holes. The suction table 40 holds the card C horizontally on the upper surface thereof by sucking or attracting the same thereto by the cooperation of the suction fan 48 and the suction holes thereof. The two guide rails 41, 41, which are supported by the left and right printer-block frames 10, respectively, support the suction table 40 thereon and guide the same for stable movement along the transport passage 8.

The printer-block conveyor belt mechanism 42 is comprised of a pair of table-carrying pulleys 44, 44 arranged at respective locations upstream of and downstream (proximal end side and distal end side with respect to) the printer device 11 in a manner opposed to each other, a table-carrying belt 45 stretched between the two table-carrying pulleys 44, 44, and a table-driving motor 46 for driving the proximal end-side table-carrying pulley 44. The table-carrying belt 45 extends between and in parallel with the pair of guide rails 41, 41. The suction table 40 is fixed to a portion of the table-carrying belt 45 via a holding piece 43.

The table-driving motor 46 is connected to the printer-side controller 14. As the table-driving motor 46 rotates, the proximal end-side table-carrying pulley 44 rotates to cause the table-carrying belt 45 to travel in the normal or reverse direction. Thus, the suction table 40 can reciprocate along the transport passage 8 while being supported and guided by the pair of guide rails 41, 41 in a laterally well-balanced fashion.

As shown in FIG. 1, when the card C is sucked and held horizontally by the suction table 40, the sheet-laminating device 80 is operated to affix an ink image-receiving sheet IS onto the surface of the card C. Subsequently, the card C moves to the printer device 11 with the movement of the suction table 40. When the suction table 40 reaches a predetermined position in front of the printer device 11, the forward end of the suction table 40 is detected by a table-detecting sensor 47 arranged above the transport passage 8, and the printer-side controller 14 drives the head unit 20 and the reciprocating mechanism 22. As a result, the head unit 20 reciprocates, and the suction table 40 is advanced intermittently, whereby an image is printed on the card C. After completion of the printing on the card C, the suction table 40 travels forward along the transport passage 8 with the card C carried thereon, until the card C is brought to the card transfer device 19.

The card transfer device 19 is comprised of a catcher, not shown, for catching a card C, and a transfer mechanism, not shown, for delivering the card C onto and from the catcher. The transfer mechanism is connected to the printer-side controller 14. The transfer mechanism carries out operation for receiving the card C from the printer-block conveyor device 13 and passing the same to the heater-block conveyor device 17, as well as operation for receiving the card C from the heater-block conveyor device 17 and passing the same to the printer-block conveyor device 13.

Immediately above the suction table 40 having moved to the forward end of the transport passage 8, there is arranged a second setting mechanism 74 corresponding to the first setting mechanism 33. The second setting mechanism 74 is comprised of a second positioning plate 84, and a second solenoid 85. Accordingly, the rear end of the card C transferred in the reverse direction from the card transfer device 19 is brought into abutment with the second positioning plate 84 and positioned thereat, followed by being sucked by the suction table 40 and set on the surface of the same.

Next, the components of the heater block 5 will be described in detail. The heater device 16 is comprised of a pair of irradiation units 50, 50 which can face a card C being fed, in a non-contacting fashion. The pair of irradiation units 50, 50 are arranged on opposite sides of the transport passage 8 in a manner parallel and vertically opposed to each other with a predetermined space therebetween. Each of the irradiation units 50, 50 is comprised of a halogen lamp 51 as a heat source and a light condensing plate 52 arcuate in cross section. The light condensing plate 52 reflects and collects lights from the halogen lamp 51. In short, the card C is fed in a state spaced from the pair of irradiation units 50, 50 by a constant distance.

Each of the halogen lamps 51 extends in the direction of the width of the apparatus 1 across a card C (i.e. the direction orthogonal to the carrying direction) and has left and right ends thereof supported by the respective heater-block frames 15. The halogen lamps 51 are each connected to the heater-side controller 18, which controls the heating temperature of the halogen lamps 51. It should be noted that the amount of heat applied to the card C can be controlled by two factors, i.e. the heating temperature of the halogen lamps 51 and the conveying speed of the card C.

Each of the light condensing plates 52 is arranged in a manner covering the corresponding halogen lamp 51 and has left and right ends thereof supported by the respective heater-block frames 15. In this embodiment, the halogen lamps 51 are optical heat sources each generating light with short wavelengths, and hence a card C has its surfaces, i.e. opposite ink image-receiving sheets IS properly heated in a state of heat transmission to the substrate layer 90 being suppressed.

The heater-block conveyor device 17 is comprised of a pair of conveying guides 60, 60 implemented by a plurality of guide rollers 68 arranged along the respective left and right sides of the transport passage 8 in a manner opposed to each other, and a heater-block conveyor belt mechanism 61 which conveys the card C in a manner pushing the same forward from behind with the card C being guided by the pair of conveying guides 60, 60. The guide rollers 68 on each side are arrayed in a manner such that the whole array extends from a location immediately downstream of the card transfer device 19 to a location immediately upstream of the card exit 7. Each guide roller 68 is in the form of an hourglass having an intermediate portion thereof constricted and rotatably supported by a holder, not shown, attached to inner surfaces of the respective heater-block frame 15. The card C is supported by the constricted portions of the guide rollers 68 arrayed in two lines parallel and opposed to each other, such that it is sandwiched from the left and right sides thereof, and stably guided forward with free rotation of the guide rollers 68.

The heater-block conveyor belt mechanism 61 is comprised of a pair of driven pulleys 62, 62 arranged at respective locations upstream and downstream of the irradiation units 50, 50, a drive pulley 63 arranged at a location below the lower irradiation unit 50 positioned below the transport passage 8, a heater-block drive motor 64 as a drive source for driving the drive pulley 63, and a heater-block conveyor belt 65 stretched around the pair of driven pulleys 62, 62 and the drive pulley 63. The driven pulleys 62, 62 and the drive pulley 63 are rotatably supported by respective pulley shafts, not shown, each having opposite ends thereof supported by the respective heater-block frames 15. The heater-block drive motor 64 is connected to the heater-side controller 18, for controlling rotation of the drive pulley 63, i.e. traveling of the heater-block conveyor belt 65 in the normal and reverse directions.

The heater-block conveyor belt 65 is stretched such that it turns around the lower irradiation unit 50. The heater-block conveyor belt 65 is formed to have a small width, and has a plurality of pushing pawls, not shown, formed on a surface thereof at predetermined space intervals. More specifically, the heater-block conveyor belt 65 is formed to have a width equal to the width of a magnetic encoder portion (magnetic stripes) of the card C and stretched in a state positioned with respect to the left-right direction such that the belt 65 can face the magnetic encoder portion of the transferred card C.

Thus, it is possible to align the heater-block conveyor belt 65 with a portion of the card C not requiring heat irradiation for image forming and fixation. Further, when the ink image-receiving sheet IS is partially laminated on the surface of a card C except the magnetic encoder portion thereof, the heater-block conveyor belt 65 blocks heat irradiation to the magnetic encoder portion of the card C, whereby it is possible to prevent thermal influence of heating against the magnetic encoder portion. In this connection, it is preferable that the heater-block conveyor belt 65 is formed of a heat resistant silicone.

Each pushing pawl revolves around the lower irradiation unit 50 as the heater-block conveyor belt 65 moves. More specifically, the pushing pawl comes into contact with the trailing end of the card C and revolves while pushing the card C. Accordingly, the card C brought to the heater device 16 and sent further toward the card exit 7 by being pushed forward by the moving pushing pawl in a state supported and held in a horizontal position by the pair of conveying guides 60, 60 on the respective left and right side. When the heater-block conveyor belt 65 moves in the reverse direction, the card C is carried toward the printer block 4 by the moving pushing pawl.

Further, the heater-block conveyor device 17 is provided with a pawl-detecting sensor 69 for detecting a pushing pawl. The pawl-detecting sensor 69 is connected to the heater-side controller 18, and determines the position of a pushing pawl such that the pushing pawl can be properly brought into contact with the trailing end of the card C so as to push the same. More specifically, the heater-side controller 18 controls such that a pushing pawl immediately preceding the pushing pawl which should push the card C is stopped at a predetermined position and functions as a stopper for stopping the card C transferred from the card transfer device 19. As a result, the card C is transferred to the heater-block conveyor belt 65, with its trailing end positioned forward of a portion of the heater-block conveyor belt 65 positioned at the proximal end, which prevents the pushing pawl for pushing the card C from failing to come into contact with the trailing end of the card C.

The heater-side controller 18 controls the heater device 16 and the heater-block conveyor device 17 based on results of detection by the printer-side controller 14 More specifically, the heater-side controller 18 determines the heating temperature and the conveying speed of the card C in the heater block 5, based on attribute information of the card C detected by the printer-side controller 14 (including the material of the substrate layer 90, the thickness of the entire card C, etc.). Further, the heater-side controller 18 controls the heating temperature and conveying speed of a card C in the heater block 5 so as to adjust the fixation depth of the sublimable dye ink (i.e. the amount of heat applied to the card C).

In succession to the double-sided printing on the card C, the heater device 16 is driven by the heater-side controller 18 to perform heating at a predetermined heating temperature based on the attribute information of the card C, whereupon the heater-block conveyor device 17 carries the card C forward over a predetermined time period while passing the same through the heater device 16 at a conveying speed dependent on the heating temperature. Then, when the heater-block conveyor device 17 has sent the card C out of the apparatus 1 via the card exit 7, the operations of the heater-block conveyor device 17 and the heater device 16 are stopped. In this case, the control of the amount of heat applied to the card C may be simplified by controlling the heating temperature alone while holding constant the conveying speed at which the card C is conveyed by the heater-block conveyor device 17. Further, the conveying speed may be determined according to a printing resolution.

The sheet peeler device 81 is comprised of a peeling mechanism, not shown, for peeling off an ink image-receiving sheet from a heated card C stopped on the heater-block conveyor device 17, and a lift mechanism, not shown, for lifting and lowering the peeling mechanism. The peeling mechanism and the lift mechanism are connected to the heater-side controller 18.

Now, an image-forming method according to the present embodiment will be described with reference to FIG. 1. In the image-forming apparatus 1, as described above, after a card C is introduced to the starting end of the printer-block conveyor device 13 from the card feeder 12, an ink image-receiving sheet IS is affixed to the card C, and then image printing is effected on the card C. Then, the printed card C is transferred to the heater-block conveyor device 17 and subjected to heating, and thereafter the ink image-receiving sheet IS is peeled off, whereby the card C printed with a desired image is produced. During this process, the heater device 16 is controlled to control the fixation depth of the sublimable dye ink fixed in the card C, whereby a forgery-preventing process is carried out based on the fixation depth.

Further, in another image-forming method considering the forgery prevention according to the present embodiment, as described in detail hereinafter, data of an image for printing is divided into data of (two) divisional images having respective different colors (i.e. color-divided), divisional images having respectively representative of different image elements (element-divided) or divisional images having respective different densities (density-divided), and printing and heating is carried out on a divisional image-by-divisional image basis. In this case, in a first cycle of the image-forming process, a first divisional image is printed on a card C, and then after execution of heat treatment and separation of an ink image-receiving sheet IS, the card C is carried in the reverse direction to the starting end of the printer-block conveyor device 13. In a subsequent second cycle of the image-forming process, a second divisional image is printed on the card C, and then after execution of heat treatment and separation of an ink image-receiving sheet IS, the card C is eventually discharged from the card exit 7. In the plurality of heating processes, the amounts of heat applied to the card C are adjusted such that they are reduced progressively from one process to another.

In the case of carrying out double-sided printing on a card C, it is preferred that the card C once discharged after execution of an image-forming process on the front surface of the card C may be put into the card feeder 12 again, or alternatively, a card-reversing device may be arranged at the proximal end of the printer-block conveyor device 13 or at the distal end of the heater-block conveyor device 17.

Next, an image-forming apparatus and method for forming an image on a card according to a second embodiment of the invention will be described with reference to FIG. 4. This image-forming apparatus is quite different in construction from that of the first embodiment. The image-forming apparatus of the present embodiment thermally transfers an image printed on an ink image-receiving sheet IS to a card C, thereby forming the image on the same.

Figure 4:
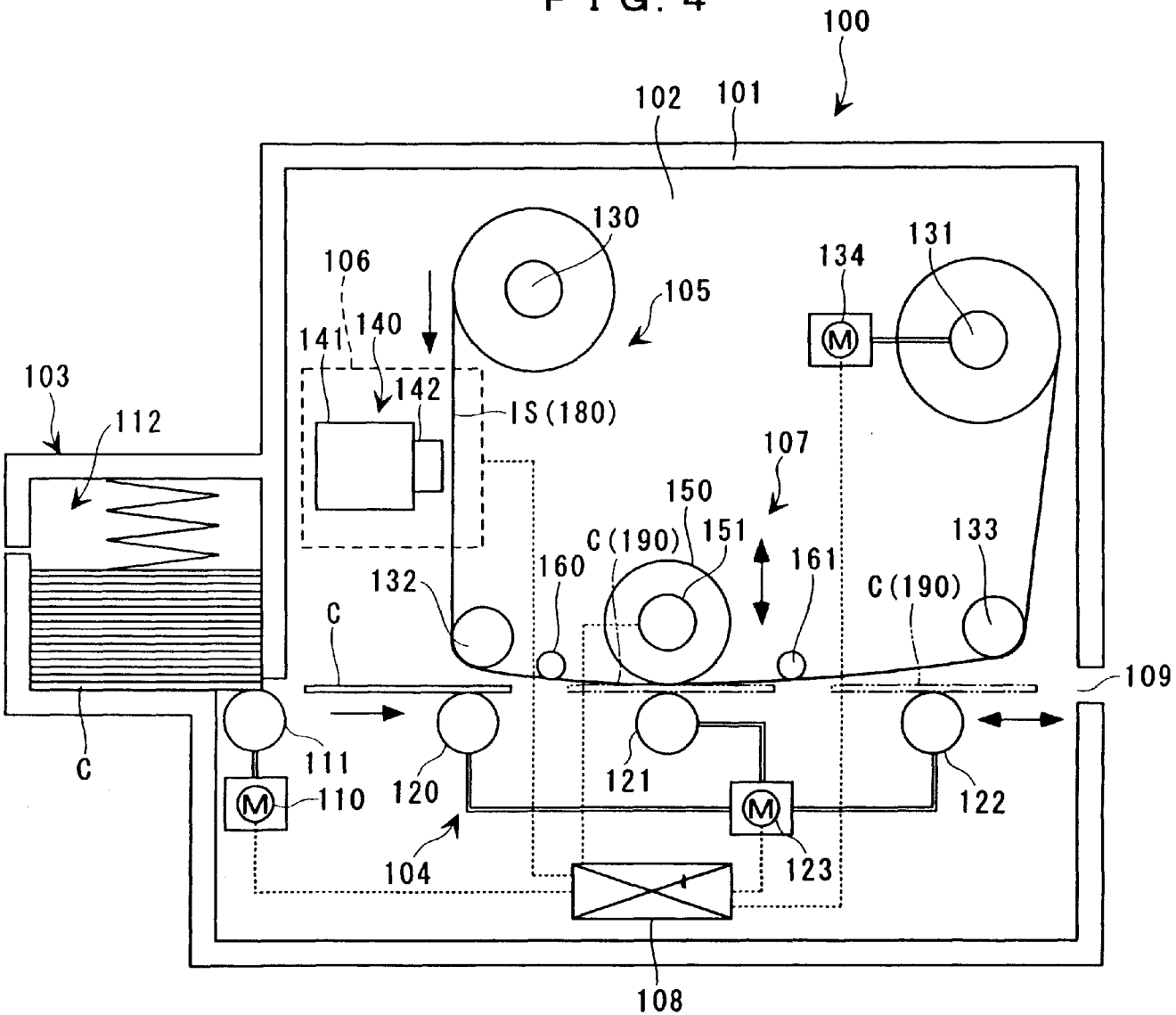
FIG. 4 is a cross-sectional view schematically showing the internal construction of an image-forming apparatus for cards, according to a second embodiment.
Figure 5A:
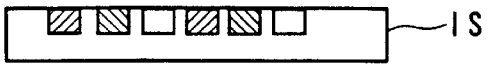
FIGS. 5A to 5D are cross-sectional views of a card, schematically illustrating a process of an image being formed on the card in the second embodiment.
Figure 5B:
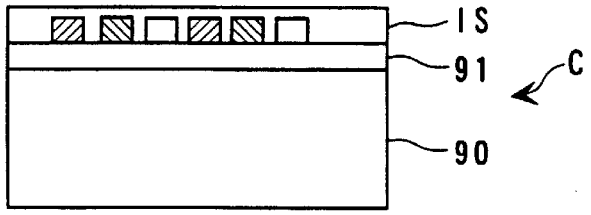
Figure 5C:
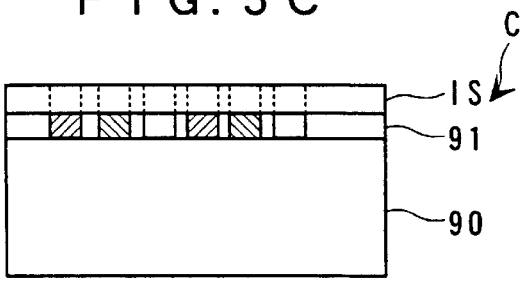
Figure 5D:
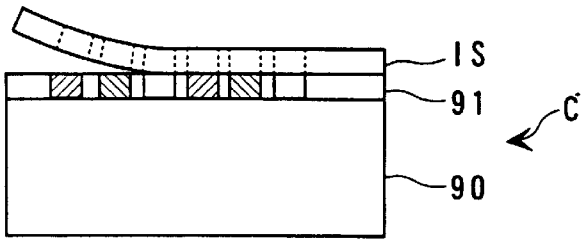

As shown in FIG. 4, the image-forming apparatus 100 has an apparatus body 102 comprised of a box-shaped casing 101, card-feeding means 103 for feeding a card C, card-conveying means 104 for conveying the card C, a card exit 109 via which the card C is delivered out of the casing 101, sheet-feeding means 105 for feeding an ink-receiving sheet IS by rolling out a roll thereof, printing means 106 for printing on the ink-receiving sheet IS rolled out by the sheet-feeding means 105, thermal pressing means 107 for affixing the printed ink-receiving sheet IS to the card C by pressure while applying heat thereto, and a controller 108 for controlling these means. The image-forming apparatus 100 carries out printing an image including characters, figures, and so forth on the ink-receiving sheet IS by the ink jet printing method using sublimable dye ink while feeding the ink-receiving sheet IS, and then affixing the printed portion of the ink-receiving sheet IS to a card C on which the portion is overlaid by pressure while applying heat thereto, thereby causing fixing and color development of the image considering forgery prevention in the card C.

The card C employed in the present embodiment is identical in construction to the card C employed in the first embodiment. Therefore, similarly to the first embodiment, the card C of the present embodiment may have a fluorine film layer 93 laminated on the surface of an ink-fixing layer 91. On the other hand, the ink image-receiving sheet IS of the present embodiment is slightly different in construction from the ink image-receiving sheet IS of the first embodiment. More specifically, the ink image-receiving sheet IS of the present embodiment is not particularly configured to have stickiness or ease of separation by heating, and provided in the form of a continuous roll. However, the ink image-receiving sheet IS is similar to that of the first embodiment in the other respects, e.g. in that the sheet IS is capable of holding sublimable dye ink temporarily.

More specifically, as shown in FIGS. 5A to 5D, when an image is printed on the ink image-receiving sheet IS by the printing means 106 by the ink jet printing method, ink droplets of the sublimable dye ink are impregnated into the ink image-receiving sheet IS and held therein. Then, the printed portion of the ink image-receiving sheet IS is aligned on the card C, and thermal pressing is carried out in a state of the ink image-receiving sheet IS and the ink-fixing layer 91 of the card C being overlaid upon each other, whereupon the ink droplets further penetrate deep into the ink-fixing layer 91 as migration particles having sizes at a molecular level. In short, the ink droplets held in the ink image-receiving sheet IS undergoes evaporation and diffusion and develops color. Then, the ink image-receiving sheet IS is separated from the card C to produce the card C having the image transferred to the ink-fixing layer 91.

Next, the components of the image-forming apparatus 100 will be described in detail. The card feed means 103 is generally similar in construction to the card feeder 12 in the first embodiment and comprised of a feed motor 110 as a drive source, a feed roller 111 rotated by the feed motor 110, and a card cassette 112 containing a plurality of cards C in a stacked state. The feed roller 111 is constantly held in rolling contact with the underside surface (of the card substrate layer 90) of a lowermost card C of the stack so as to reliably feed the cards C one by one from the card cassette 112 onto the card-conveying means 104. For more details, the first embodiment should be referred to.

Similarly, the printing means 106 is generally similar in construction to the printer device 11 in the first embodiment. More specifically, the printing means 106 is comprised of a head unit 140, a carriage motor as a drive source, and a reciprocating mechanism which receives torque from the carriage motor to reciprocate the head unit 140. The head unit 140 is comprised of an ink jet head 142 having a plurality of nozzles formed on an underside surface thereof, an ink cartridge which supplies ink to the ink jet head 142, and a carriage 141 carrying the ink jet head 142 and the ink cartridge.

In the present embodiment, similarly to the first embodiment, the carriage 141 is caused to reciprocate by the reciprocating mechanism, and during the reciprocating motion of the carriage 141, ink droplets are ejected from the ink jet head 142 as required, whereby printing is effected on the ink image-receiving sheet IS. More specifically, in the present embodiment, while the ink image-receiving sheet IS is intermittently fed to pass before the head unit 140 along a sheet traveling passage 180, the head unit 140 performs reciprocating motion in a direction orthogonal to the direction of feeding of the ink image-receiving sheet IS, whereby printing is performed on the ink image-receiving sheet IS. It should be noted that preferably in the present embodiment, a mirror or reverse image of a desired image is printed on the ink image-receiving sheet IS so as to form a normal image after transfer onto the card C.

The card-conveying means 104 is comprised of a transport roller 120, a press roller 121, and a discharge roller 122 arranged at respective upstream, intermediate, and downstream locations along a card-transport passage 190 for communication between the card feed means 103 and the card exit 109, a drive motor 123 as a drive source, and a torque-transmitting mechanism, not shown, including a belt, gears, etc. for transmitting torque from the drive motor 123 to the rollers. In the present embodiment, the press roller 121 functions not only as a main component of the thermal pressing means 107, but also as a part of the card-conveying means 104 for sending the card C to the discharge roller 122.

When the card C is fed from the feed roller 111, the transport roller 120 rolls in rolling contact with the underside surface of the card C to transfer the same along the card-transport passage 190 to the press roller 121. Further, the transport roller 120 rolls in synchronism with feed of the ink image-receiving sheet IS by the sheet-feeding means 105 so as to transport the card C to the press roller 121 such that the printed portion of the ink image-receiving sheet IS can be accurately aligned on the card C at a location facing the thermal pressing means 107.

The press roller 121 rolls in rolling contact with the underside surface of the card C to transfer the same along the card-transport passage 190 to the discharge roller 122, and cooperates with a heat roller 150 to feed the card C by rotation in a state sandwiching the same therebetween. In other words, the card C is firmly pressed from opposite sides between the press roller 121 and the heat roller 150 via the ink image-receiving sheet IS in a state of the ink-fixing layer 91 as an uppermost surface thereof facing toward the heat roller 150.

The discharge roller 122 rolls in rolling contact with the underside surface of the card C transferred from the press roller 121 to advance the card C along the card-transport passage 190 and discharge the same via the card exit 109. The torque-transmitting mechanism causes the drive motor 123 as a single drive source to rotate the transport roller 120, the press roller 121 and the discharge roller 122 in a synchronous manner. In short, the card C is fed horizontally along the card-transport passage 190 at a constant speed.

The transport roller 120, the press roller 121 and the discharge roller 122 can each perform normal and reverse rotations, which makes it possible to carry the card C in both normal and reverse directions along the card-transport passage 190. More specifically, the card C can be fed in the reverse direction from the discharge roller 122 through the press roller 121 to the transport roller 120, and then brought to the thermal pressing means 107.

The sheet-feeding means 105 is comprised of a supply reel 130 for rolling out the ink image-receiving sheet IS from a left-hand roll thereof as viewed in the figure, a take-up reel 131 for taking up the ink image-receiving sheet IS into a right-hand roll thereof as viewed in the figure, a first guide roller 132 for guiding the image-receiving sheet IS rolled out by the supply reel 130 to the printing means 106, a second guide roller 133 for guiding the image-receiving sheet IS from the first guide roller 132 to the thermal pressing means 107, a take-up motor 134 for driving the take-up reel 131, and a pair of passage projections 160, 161 projecting at respective locations on transversely opposite sides of the thermal pressing means 107. The supply reel 130, the first guide roller 132 and the second guide roller 133 are rotatable members, and the first guide roller 132, the thermal pressing means 107, the second guide roller 133 and the pair of passage projections 160, 161 form the sheet traveling passage 180 from the supply reel 130 to the take-up reel 131.

The supply reel 130 is arranged at a location upstream of the printing means 106. A roll of the unused ink image-receiving sheet IS is wound around the supply reel 130. The ink image-receiving sheet IS is wound around the supply reel 130 such that an image-receiving surface thereof faces toward the head unit 140 when the sheet IS is unrolled and passes in front of the head unit 140. The first guide roller 132 is arranged at a location downstream of the printing means 106 in a manner opposed to the transport roller 120 via the card-transport passage 190. The supply reel 130 and the first guide roller 132 are disposed at the respective locations on vertically opposite sides of the printing means 106 and form the sheet traveling passage 180 parallel to the head unit 140, along which the ink image-receiving sheet IS is fed.

The pair of passage projections 160, 161 are formed by a first passage projection 160 located between the first guide roller 132 and the thermal pressing means 107, and a second passage projection 161 located between the thermal pressing means 107 and the second guide roller 133. The pair of passage projections 160, 161 are arranged in parallel with the sheet traveling passage 180 so as to hold the ink image-receiving sheet IS in parallel with the card-transport passage 190. More specifically, the printed portion of the ink image-receiving sheet IS is advanced via the first guide roller 132 and guided by the first passage projection 160 travels between the pair of passage projections 160, 161 with its image-receiving surface being in parallel with the card C.

The take-up reel 131 is driven for rotation by the take-up motor 134 to take up the ink image-receiving sheet IS after being subjected to the thermal pressing. More specifically, the ink image-receiving sheet IS is rolled out from the supply reel 130 by rotation of the take-up reel 131 and taken up by the take-up reel 131. The second guide roller 133 is arranged between the take-up reel 131 and the second passage projection 161 in a manner opposed to the discharge roller 122 via the card-transport passage 190.

More specifically, the second guide roller 133 guides the ink image-receiving sheet IS passing the heat roller 150 and the second passage projection 161 and being taken up by the take-up reel 131 via, such that the ink image-receiving sheet IS is advanced in an inclined or obliquely upward direction with respect to the card-transport passage 190. In short, the second guide roller 133 not only guides the feed of the ink image-receiving sheet IS but also serves as separation means for separating the ink image-receiving sheet IS affixed to the card C by the thermal pressing means 107, from the card C.

The thermal pressing means 107 is comprised of the press roller 121, the heat roller 150 opposed to the press roller 121 via the card-transport passage 190 and the sheet traveling passage 180, a heater 151 incorporated in the heat roller 150 and functioning as a heat source and a lift mechanism for lifting and lowering the heat roller 150. The heat roller 150 has a predetermined length corresponding to the width of the card C. The lift mechanism lifts and lowers the heat roller 150 to thereby adjust pressure applied to the press roller 121 (the ink image-receiving sheet IS). The heat roller 150 may be formed by a metal roller formed e.g. of stainless having a predetermined surface smoothness, but more preferably, it is formed by a heat-resistant rubber roller.

The heater 151 is connected to the controller 108 and uniformly keeps the heat in the heat roller 150 in a direction of its length. The sheet traveling passage 180 and the card-transport passage 190 merge with each other between the heat roller 150 and the press roller 121, and at this merging point, the ink image-receiving sheet IS and the card C are firmly pressed against each other from above and below and advanced at a constant speed with rotation of the two rollers.

The controller 108 includes a CPU 210 and the like performing various kinds of control processes described in detail hereinafter. Within the casing 101, there are arranged two sensors, not shown, connected to the controller 108 and facing the sheet traveling passage 180 at respective locations on opposite sides of the printing means 106 and a sensor, not shown, facing the card-transport passage 190 at a location close to the transport roller 120. The position of a printed portion of the ink image-receiving sheet IS is detected by these sensors, and based on the sensed position of the printed portion, the printed portion of the ink image-receiving sheet IS and a card C fed by the transport roller 120 are properly aligned with each other and passed through the thermal pressing means 107.

The detailed flow of operations for forming an image on a card C is as follows. After printing is carried out on the ink image-receiving sheet IS by the printing means 106, the ink image-receiving sheet IS is fed to the heat roller 150 by the sheet-feeding means 105, while the card C delivered from the card feed means 103 is fed to the press roller 121 by the card-conveying means 104. At this time, the card C and the ink image-receiving sheet IS are sandwiched between the heat roller 150 and the press roller 121, and the printed portion of the ink image-receiving sheet IS is firmly pressed on the card C in a heated state. In other words, the heat roller 150 and the press roller 121 roll in rolling contact with the ink image-receiving sheet IS and the card C along the width thereof while advancing the sheet IS and the card C together. Then, the ink image-receiving sheet IS is taken up while being separated from the card C, whereas the card C having the image fixedly formed thereon is discharged via the card exit 109 to the user.

In the image-forming method according to the present embodiment, which contemplates forgery prevention, as described in detail hereinafter, the data of an image for printing is color-divided (in two), and then the two divisional images are each printed and heated. In this case, in the first cycle of the image-forming process, a first divisional image is printed on the ink image-receiving sheet IS, and then after execution of thermal pressing and separation of the ink image-receiving sheet IS, the card C is carried in the reverse direction to the transport roller 120. Then, in the following cycle of the image-forming process, a second divisional image is printed on the sheet IS, and then after execution of thermal pressing and separation of the ink image-receiving sheet IS, the card C is eventually discharged from the card exit 109.

It should be noted that a sheet cartridge having a cartridge casing containing the supply reel 130, the take-up reel 131 and the ink image-receiving sheet IS may be provided and removably mounted in the casing 101. In this case, the sheet traveling passage 180 for travel of the ink image-receiving sheet IS is formed within the cartridge casing, and openings are formed through the cartridge casing at respective locations opposed to the heat roller 150 and the head unit 140. This method makes it easy to preserve or carry an ink image-receiving sheet IS.

Figure 6:
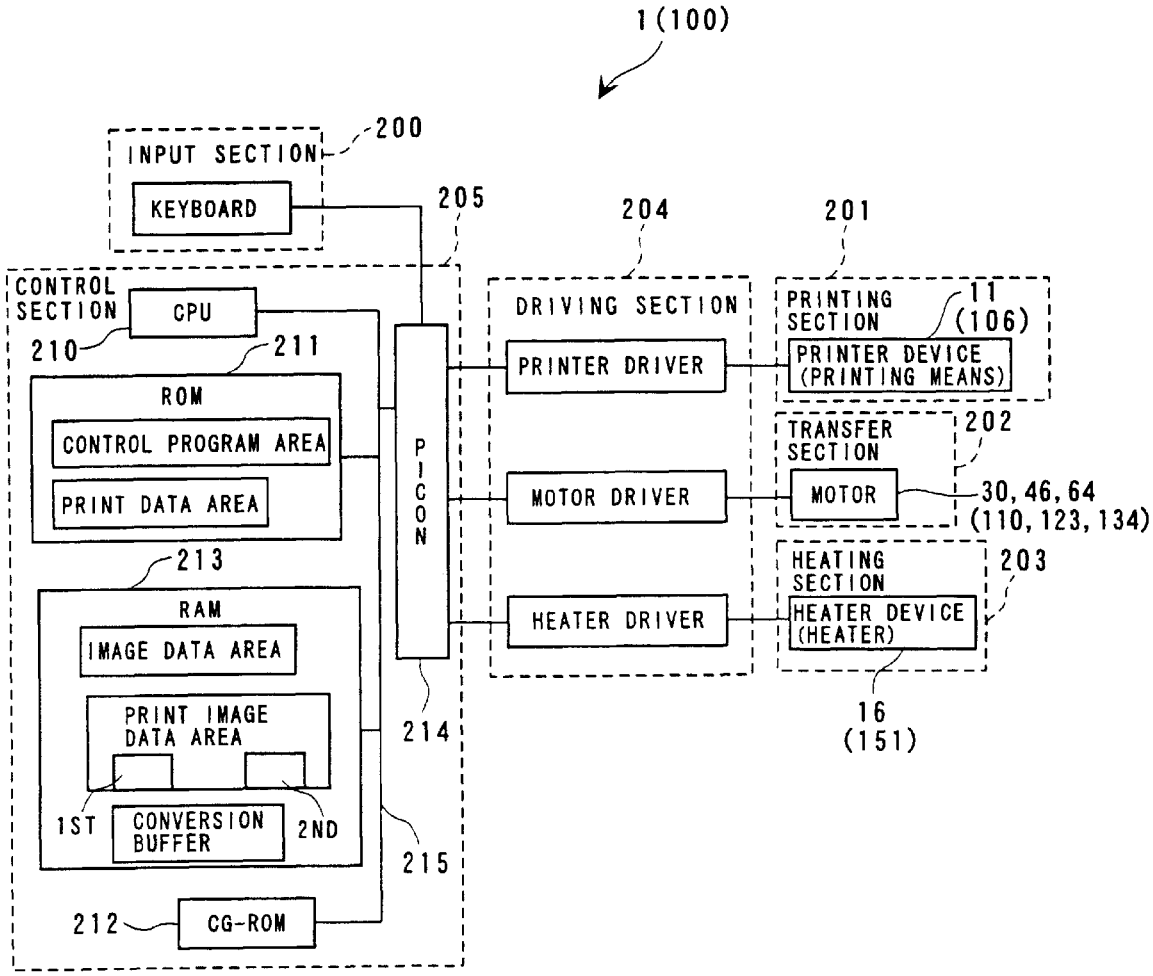
FIG. 6 is a block diagram showing a control system of the image-forming apparatus for cards, according to the first and second embodiments.

Description will now be given of a control system of the image-forming apparatus 1 (or 100) according to the first (or second) embodiment. As shown in FIG. 6, the apparatus body of the image-forming apparatus 1 (100) incorporates an input section 200 operated by the user via a keyboard to input image data from an external device, such as a personal computer, a printing section 201 including the printer device 11 (printing means 106) for printing an image on an ink image-receiving sheet IS, a transfer section 202 including a feed motor for feeding the ink image-receiving sheet IS and a card C, a heating section 203 including the heater device 16 (heater 151) for applying heat treatment to the card C via the printed ink image-receiving sheet IS, a driving section 204 including a printer driver for driving the printer device 11 (printing means 106), a feed motor driver for driving the feed motor, and a heater driver for driving the heater device 16 (heater 151), and a control section 205 (controller 9 (controller 108)) for controlling the sections within the image-forming apparatus.

The control section 205 includes a CPU 210, a ROM 211, a character generator ROM 212 (CG-ROM 212), a RAM 213, and a P-CON 214, all of which are connected to each other by an internal bus 215. The ROM 211 has a control program area for storing control programs executed by the CPU 210 as well as a control data area for storing control data including a character table, a color division (element division, density division) table and the like. The CG-ROM 212 stores bitmap data, i.e. data defining characters, symbols, figures and the like, provided for the image-forming apparatus 1 (100). When code data specifying a character or the like is input thereto, the CG-ROM 212 outputs the corresponding bitmap data.

The RAM 213 includes an image data area for storing register groups as well as image data entered received from outside, a print image data area for storing image data for printing, and various division buffer areas, such as an image element division buffer area and a color division buffer area (including four buffers, i.e. a Y (yellow) color buffer, a C (cyan) color buffer, an M (magenta) color buffer and a K (black) color buffer). The RAM 213 is used as a work area for carrying out the control process.

The print image data area is further divided into a first print image data area and a second print image data area. Data stored in the first print image data area is printed in a first printing operation during the first cycle of the image-forming process, while data stored in the second print image data area is printed in a second printing operation during the second cycle of the image-forming process.

The P-CON 214 incorporates logic circuits for complementing the functions of the CPU 210 as well as handling interface signals for interfacing between the CPU 210 and peripheral circuits. The logic circuits are implemented by gate arrays, a custom LSI and the like. The P-CON 250 is connected to the keyboard, for receiving commands and image data entered via the input section 200, and inputting these to the bus 215 directly or after processing them. Further, the P-CON 214 cooperates with the CPU 210 to output data and control signals input to the bus 215 by the CPU 210 or the like, to the driving section 204 directly or after processing them.

The CPU 210 receives detection signals, commands and data from the components of the image-forming apparatus 1 (100) via the P-CON 214, according to the control program read from the ROM 211, processes font bitmap data from the CG-ROM 212 and various data stored in the RAM 213, and delivers control signals to the driving section 204 via the P-CON 214 to thereby control the printer device 11 (printing means 106), the feed motor, the heater device 16 (heater 151) and the like so as to carry out printing on a card C and heat the same under predetermined printing and heating conditions. Thus, the CPU 210 controls the overall operation of the image-forming apparatus 1 (100).

For instance, in a process of image division (color division) which is executed by the CPU 210, color image data entered via the input section 200 (assuming that the entered image data is formed of C (cyan) data and Y (yellow) data) is stored in the image data area within the RAM 213, and further stored in corresponding color division buffers. In this example, C data is read out from a buffer associated with the C color, and then the data is synthesized according to the control program, followed by being stored as C data in the first print image data area. Similarly, Y data is read out from a buffer associated with the Y color, and then the data is synthesized and stored as Y data in the second print image data area. Thereafter, the first printing operation is controlled based on the C data within the first print image data area, and the second printing operation is controlled based on the Y data within the second print image data area.

The amount of heat to be applied by the heating device 16 (heater 151) is controlled on a printing process-by-printing process basis, such that the amount of heat required for a heating process after the second printing process is smaller than the amount of heat required for a heating process after the first printing process. In short, the amount of heat is controlled to be sequentially reduced in a plurality of heating operations.

The apparatus may be configured such that two kinds of image data generated in advance by a personal computer can be inputted and the order of printing the two data in the first printing operation and the second printing operation (that is, the allocation of storage areas, i.e. the first print image data area and the second print image data area, to the respective data,) can be designated by operating the keyboard. Further, in this case, the two kinds of image data may be an image having two-layered structure (so-called layered image) which can be synthesized and entered as a single item of image data.

Further, although in the above embodiment, the color image data are divided into the Y data and the C data, the color image data having a density of 100% as a whole may be divided into data having a density of 70% for the first printing process and data having a density of 30% for the second printing process, such that the density-divisional image for the first image-forming operation has a higher density than the density-divisional image for the second image-forming operation.

Moreover, although in the above embodiment, two printing operations are carried out in the respective cycles of the image-forming process, needless to say, it is possible to carry out more than two printing operations in respective cycles of the image-forming process.

It should be noted that when the image data contains character codes e.g. of letters, each character code is converted to bitmap data corresponding to the entered character code by the CG-ROM 212, and the bitmap data is synthesized with the C data (or the Y data), followed by being stored in the first print image data area (or the second print image data area).

Figure 7:
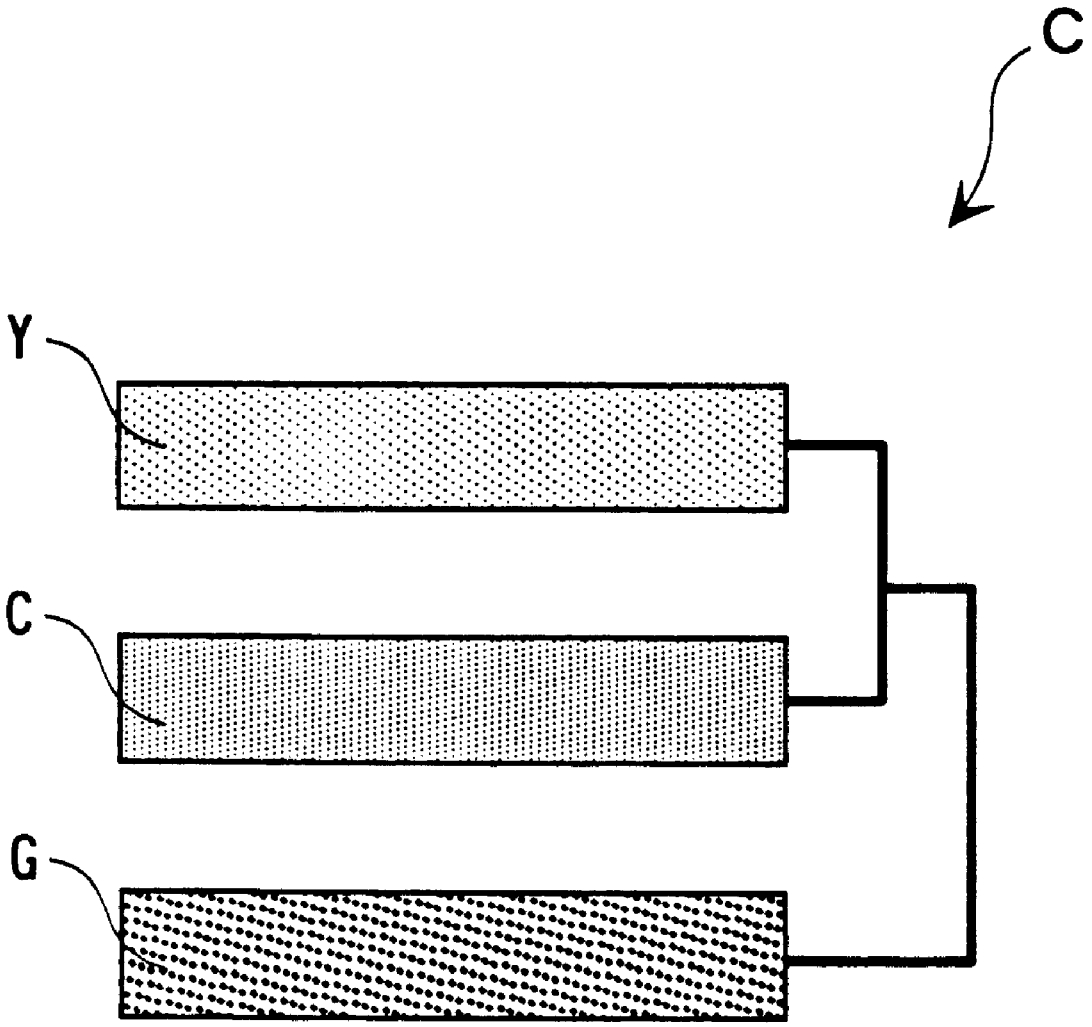
FIG. 7 is a view useful in explaining an image formed on a card by dividing the image into a plurality of divisional images having respective different colors, in which an upper layer, a lower layer and a surface of a card are shown in plan view.
Figure 8:
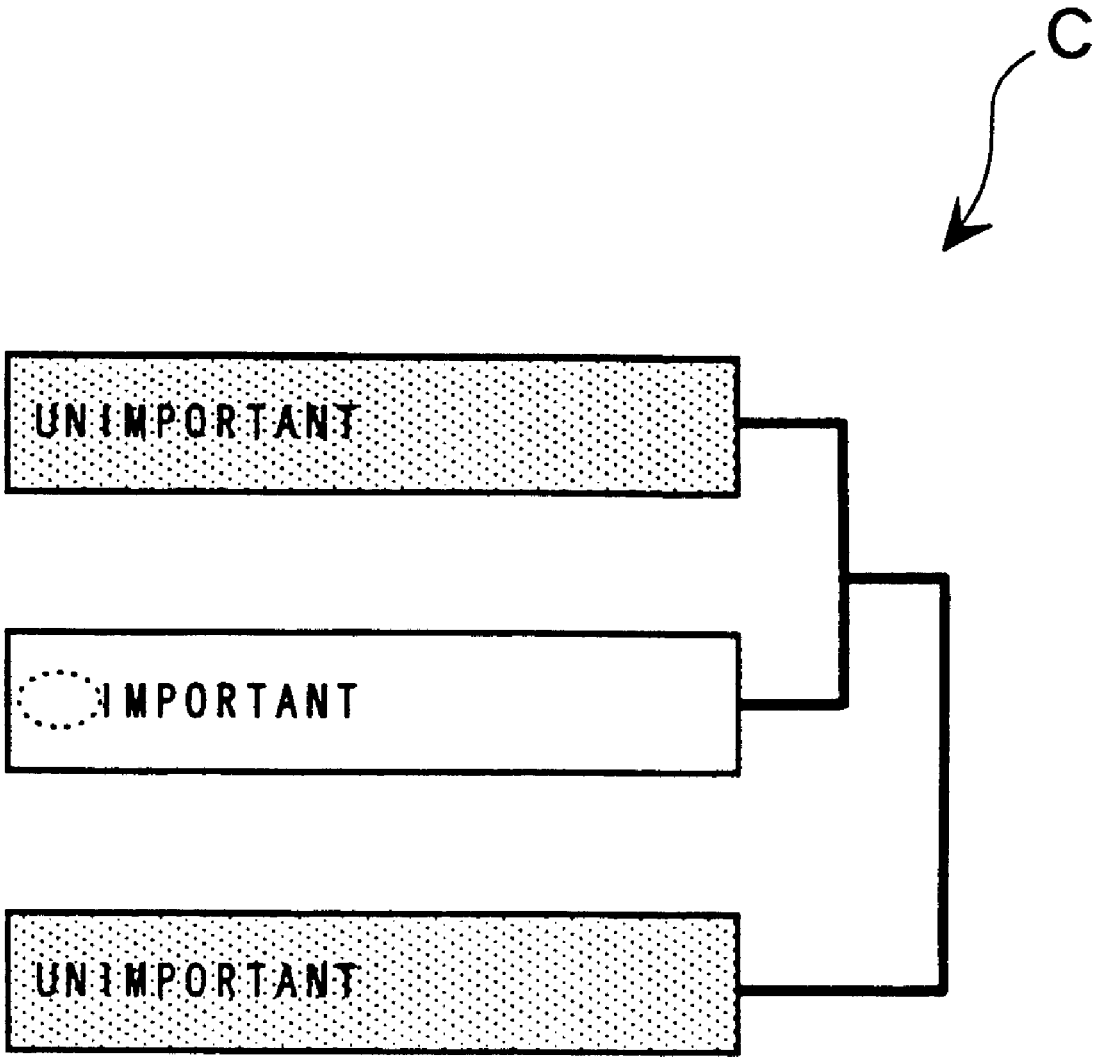
FIG. 8 is a view useful in explaining an image formed on a card by dividing the image into a plurality of divisional images representative of respective different image elements, in which an upper layer, a lower layer and a surface of a card are shown in plan view.
Figure 9:
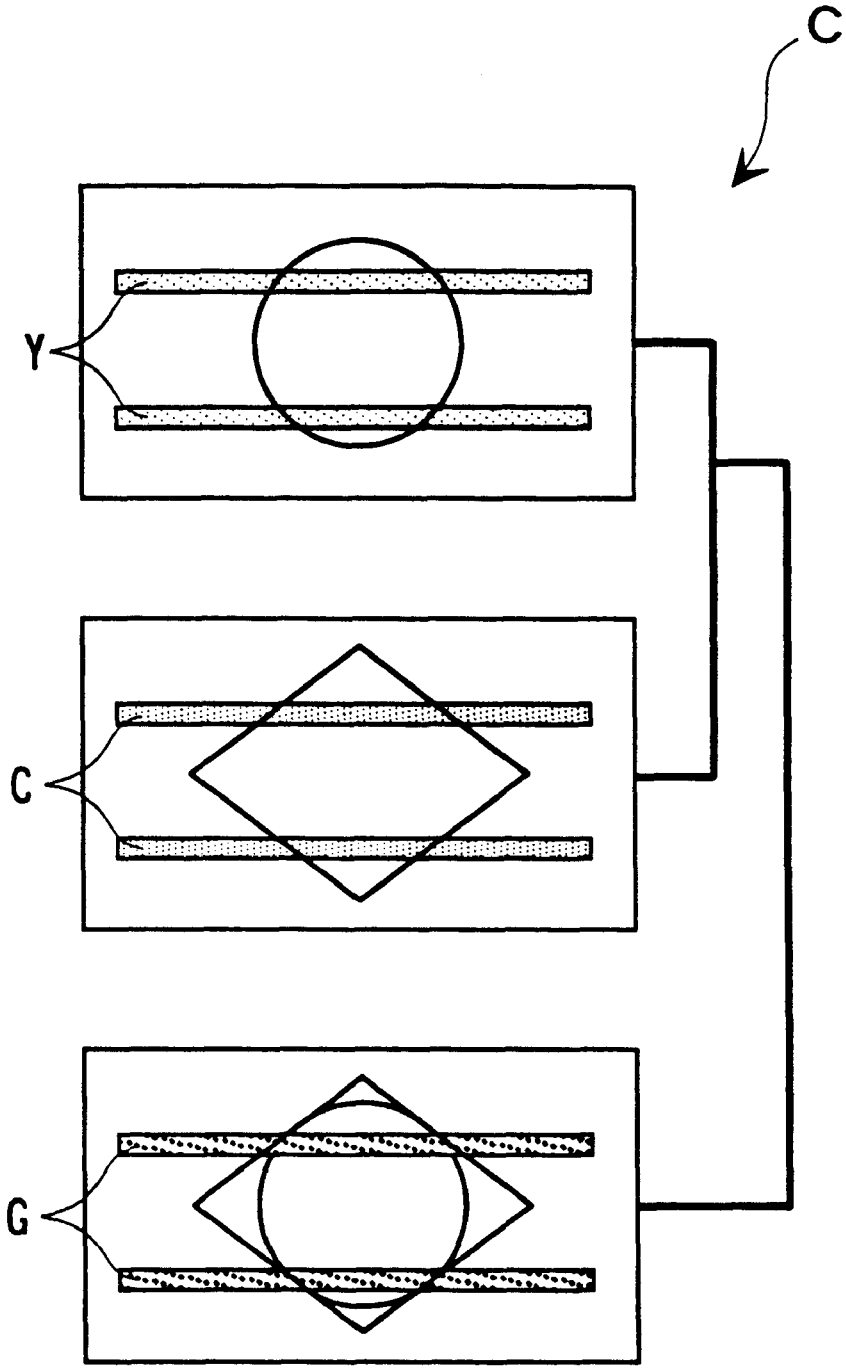
FIG. 9 is a view useful in explaining an image formed on a card by dividing the image into a plurality of divisional images having respective different colors and representative of respective different image elements, in which an upper layer, a lower layer and a surface of a care are shown in plan view.

Now, referring to FIGS. 7 to 9, description will be given of cases in which an image is formed on a card C by using the image-forming apparatus 1 (100) in consideration of preventing forgery. FIG. 7 illustrates an example of an image formed on a card by dividing the image into a plurality of divisional images having respective different colors, while FIGS. 8 and 9 illustrate images formed on a card by dividing the image into a plurality of divisional image representative of respective different image elements. Each of the figures shows an upper layer, a lower layer and a card surface in plan view.

FIG. 7 shows the image which is color-divided into divisional images having two colors, i.e. the C color and the Y color. As described in the above explanation of the processing executed by the CPU 210, printing is carried out on a divisional image-by-divisional image basis. In the present example, first, the C-colored image (image of C color) is printed, and a heating operation is executed with a predetermined amount of heat. As a result, the C-colored image is fixed in the lower layer (e.g. the substrate layer 90) which forms a deeper portion of the surface layer of the card C. Subsequently, the Y-colored image (image of Y color) is printed, and a heating operation is executed with a smaller amount of heat than in the above heating operation. As a result, the Y-colored image is fixed in the upper layer (e.g. the ink-fixing layer 91) which forms a shallower portion of the surface layer of the card C.

Accordingly, since the C color and the Y color look mixed from the outside, the appearance of the card C viewed in plane view has a G (green) color. This makes it possible to easily determine whether or not the card C is a forgery by checking the fixation depths and colors of the respective fixed sublimable dye inks by inspecting the cross section of the card C. Further, it is possible to conceal the fixation depths of respective sublimable dye inks of different colors which are fixed in the surface layer of the card C.

Further, it is preferable that a color-divisional image for printing in the first image-forming operation has a darker color, and the other color-divisional image for printing in the second image-forming operation has a brighter color, so as to make it possible to utilize elements based on the brightness and darkness of the colors in the inspection of the cross section of the card C, for easier determination as to whether forgery has been committed of the card C.

On the other hand, in FIG. 8, there are provided two divisional image elements, a first print image "IMPORTANT" formed in the lower layer and a second print image "UNIMPORTANT" formed in the upper layer, and these print images are caused to partially overlap each other to form an entire image on the card C. Also in this case, printing/heating operations similar to the above are repeatedly carried out, and the amount of heat applied by heating is progressively reduced from one cycle to another. Therefore, although the image viewed on the card C in plan view just appears identical to the second print image "UNIMPORTANT", since the manner of division of the image is very complicated, the card C can be made very difficult to forge, without spoiling ease of determination as to whether forgery has been committed.

Further, in FIG. 9, there are provided two divisional image elements as a first print image formed of a circle "○" and two bars "=" formed in the lower layer and a second print image formed of a rhombus "◇" and two bars "=" formed in the upper layer, and at the same time, for color division, the bars "=" in the first print image are colored in the C color, and the bars "=" in the second print image are colored in the Y color. These print images are printed on the card C in a manner such that the bars thereof are superimposed one upon the other to form an image on the card C. Also in this case, printing/heating processes similar to the above are repeatedly carried out, and the amount of heat applied by heating is progressively reduced from one cycle to another. Therefore, the image formed on the card C in plan view appears as an image formed of the cycle "○", the rhombus "◇" and the two bars "=" of the G color. This image-forming method is more effective in preventing forgery of the card C.

It is further understood by those skilled in the art that the foregoing is a preferred embodiment of the invention, and that various changes and modifications may be made without departing from the spirit and scope thereof.

What is claimed is:

1. A method of forming a forgery-preventive image, comprising the steps of:

printing an image on an ink image-receiving sheet by using a sublimable dye ink, thereby causing the sublimable dye ink to be held by the ink image-receiving sheet;

heating the image-receiving sheet and a medium body overlaid upon each other, thereby causing diffusion of the sublimable dye ink held in the ink image-receiving sheet in a surface of the medium body and color development, and controlling an amount of heat applied to the ink image-receiving sheet and the medium body so as to adjust depth of diffusion of the sublimable dye ink.

2. A method according to claim 1, further including the step of dividing data of the image into data of a plurality of divisional images, and the step of separating the ink image-receiving sheet and the medium body which have been heated, from each other, and the step of printing includes printing one of the plurality of divisional images on a new ink image-receiving sheet, and wherein a cycle of the step of printing, the step of heating, and the step of separating is repeated a number of times corresponding to the number of the plurality of divisional images, and wherein the step of controlling the amount of heat includes progressively reducing the amount of heat as the cycle is repeated.

3. A method according to claim 2, further including the step of overlaying the ink image-receiving sheet on the medium body, prior to the step of printing, and wherein the cycle includes the step of overlaying.

4. A method according to claim 3, wherein the ink image-receiving sheet is formed such that the ink image-receiving sheet can be affixed to the medium body, and the step of overlaying includes affixing the ink image-receiving sheet to the medium body.

5. A method according to claim 2, further including the step of overlaying the ink image-receiving sheet on the medium body, which is carried out posterior to the step of printing and simultaneously with the step of heating, and wherein the cycle includes the step of overlaying which is carried out simultaneously with the step of heating.

6. A method according to claim 2, wherein the step of dividing the data of the image includes dividing the data of the image into data of a plurality of divisional images having respective different colors.

7. A method according to claim 6, wherein the number of the plurality of divisional images is two, and the method further including the step of setting one of the two divisional images to be formed when the cycle is executed first to one having a darker color, and another of the two divisional images to be formed when the cycle is executed next to one having a lighter color.

8. A method according to claim 2, wherein the step of dividing the data of the image includes dividing the data of the image into data of a plurality of divisional images representative of respective different image elements.

9. A method according to claim 8, wherein the number of the plurality of divisional images is two, and wherein one of the two divisional images to be formed when the cycle is executed first, and another of the two divisional images to be formed when the cycle is executed next are caused to partially overlap each other.

10. A method according to claim 2, wherein the step of dividing the data of the image includes dividing the data of the image into data of a plurality of divisional images having respective different densities.

11. A method according to claim 10, wherein the number of the plurality of divisional images is two, and the method further including the step of setting one of the two divisional images to be formed when the cycle is executed first to one having a higher density, and another of the two divisional images to be formed when the cycle is executed next to one having a lower density.

12. A method according to claim 2, wherein the medium body includes a white layer forming a substrate layer and permitting ink fixation, and a transparent layer laminated on a surface of the white layer and permitting ink fixation, and wherein the number of the plurality of divisional images is two, and wherein the sublimable dye ink is heated and fixed in a surface layer of the white layer when the cycle is executed first, while the sublimable dye ink is heated and fixed in the transparent layer when the cycle is executed next.

13. A method according to claim 1, wherein the medium body has a fluorine film layer laminated on an outermost surface layer thereof on which the ink image-receiving sheet is to be overlaid.

14. A method according to claim 1, wherein the medium body is a card.

15. A method according to claim 1, wherein the step of printing includes printing by an ink jet printing method.

16. A method according to claim 1, wherein the step of heating includes causing the print medium to pass by a heat source which is being driven for heating, at a constant speed, and the step of controlling the amount of heat includes controlling at least one of a temperature of the heat source and a speed of the print medium.

17. An apparatus for forming a forgery-preventive image, comprising:

printing means for printing an image on an ink image-receiving sheet by using a sublimable dye ink, thereby causing the sublimable dye ink to be held by the ink image-receiving sheet;

heating means for heating the image-receiving sheet and a medium body overlaid upon each other, thereby causing diffusion of the sublimable dye ink held in the ink image-receiving sheet in a surface of the medium body and color development, and heat amount control means for controlling an amount of heat applied to the ink image-receiving sheet and the medium body so as to adjust depth of diffusion of the sublimable dye ink.

18. An apparatus according to claim 17, further including:

image dividing means for dividing data of the image into data of a plurality of divisional images, separation means for separating the ink image-receiving sheet and the medium body which have been heated, from each other, and control means for controlling operations of said printing means, said heating means, said separation means, and said heat amount control means, based on the data of the plurality of divisional images formed by said image dividing means, and wherein said printing means prints one of the plurality of divisional images on a new ink image-receiving sheet, and wherein said control means carries out control such that a cycle of printing on the ink image-receiving sheet by said printing means, heating of the ink image-receiving sheet and the medium body overlaid upon each other by said heating means, and separation of the ink image-receiving sheet and the medium body overlaid upon each other from each other by said separation means is repeated a number of times corresponding to the number of the plurality of divisional images, and that the amount of heat is progressively reduced by said heat amount control means as the cycle is repeated.

19. An apparatus according to claim 18, further including:

ink image-receiving sheet supply means for supplying a new ink image-receiving sheet; and overlay means for overlaying the ink image-receiving sheet and the print medium upon one another, and wherein the cycle includes supplying of the ink image-receiving sheet by said ink image-receiving sheet supply means, and overlaying of the ink image-receiving sheet and the print medium upon one another by said overlay means.

20. An apparatus according to claim 19, wherein said overlay means overlays the ink image-receiving sheet and the medium body upon each other prior to printing by said printing means.

21. An apparatus according to claim 19, wherein said overlay means is formed integrally with said heating means, and overlays the ink image-receiving sheet and the medium body upon each other posterior to printing of said divisional image by said printing means and simultaneously with heating by said heating means.

22. An apparatus according to claim 19, wherein said image dividing means divides the data of the image into data of a plurality of divisional images having respective different colors.

23. An apparatus according to claim 19, wherein said image dividing means divides the data of the image into data of a plurality of divisional images representative respective different image elements.

24. An apparatus according to claim 19, wherein said image dividing means divides the data of the image into data of a plurality of divisional images having respective different densities.

25. An apparatus according to claim 18, wherein the medium body is a card.

26. An apparatus according to claim 18, wherein said printing means carries out printing by an ink jet printing method.

27. An apparatus according to claim 18, wherein said heating means includes a heat source, and a media feed mechanism for causing the print medium to pass by said heat source which is being driven for heating, at a constant speed, and wherein said heat amount control means controls the amount of heat by controlling at least one of a temperature of the heat source and a speed of the print medium fed by said media feed mechanism.

* * * * *